US007943212B2

(12) United States Patent
Nusca et al.

(10) Patent No.: US 7,943,212 B2
(45) Date of Patent: May 17, 2011

(54) MIXED TURF AND METHOD FOR ITS PRODUCTION

(76) Inventors: Roberto Nusca, Arena Metato (IT); Marco Volterrani, Arena Metato (IT)

( * ) Notice: Subject to any disclaimer, the term of this patent is extended or adjusted under 35 U.S.C. 154(b) by 935 days.

(21) Appl. No.: 11/572,004

(22) PCT Filed: Nov. 30, 2004

(86) PCT No.: PCT/IB2004/003923
§ 371 (c)(1),
(2), (4) Date: May 17, 2007

(87) PCT Pub. No.: WO2006/008579
PCT Pub. Date: Jan. 26, 2006

(65) Prior Publication Data

US 2007/0248773 A1 Oct. 25, 2007

(30) Foreign Application Priority Data

Jul. 15, 2004 (IT) ..... PI2004A0052

(51) Int. Cl.
*A01N 3/00* (2006.01)

(52) U.S. Cl. ..... 428/17; 428/15

(58) Field of Classification Search ..... 428/15, 428/17
See application file for complete search history.

(56) References Cited

U.S. PATENT DOCUMENTS

| | | | | |
|---|---|---|---|---|
| 5,187,894 | A * | 2/1993 | Ripley et al. | 47/86 |
| 5,301,466 | A | 4/1994 | Egan et al. | |
| 5,958,527 | A | 9/1999 | Prevost et al. | |
| 6,689,447 | B2 * | 2/2004 | Prevost | 428/87 |
| 2002/0132099 | A1 * | 9/2002 | Squires | 428/220 |

FOREIGN PATENT DOCUMENTS

| | | | |
|---|---|---|---|
| DE | 3631716 | A1 | 3/1988 |
| EP | 724825 | A | 8/1996 |

* cited by examiner

*Primary Examiner* — Gordon R Baldwin
(74) *Attorney, Agent, or Firm* — Dennison, Schultz & MacDonald

(57) ABSTRACT

Turf (1) for playing sport, for recreation and/or for ornamental purpose comprising a flexible not biodegradable support (5) having a plurality of holes (6) for allowing the drainage of water through the support (5) same. To the flexible support (5) fibres (20) are connected of artificial material in order to form a turf of artificial blades extending from the upper side of the support (5). The fibres (20) are then kept substantially vertical by granular filling material (25), can be made of rubber granules (26). The turf (1) is therefore completed by living vegetable material put into the granular material by means of sowing, transplantation of portions of plants (15) or a combination thereof. Finally, the living vegetable material in the form of seeds (27), or of portions of plants (15), is watered and dressed as known in the art. The turf can be easily carried, rolled up, turned over without spreading the granular material, and laid in a desired moment on a desired support surface for immediate use.

18 Claims, 2 Drawing Sheets

MIXED TURF AND METHOD FOR ITS PRODUCTION

FIELD OF THE INVENTION

The present invention relates to a method for making a turf for playing sport, for recreation or for ornamental purpose. For example, the turf according to the invention can be used as field for playing sport such as soccer, 5 players soccer, tennis, hockey, football, golf, athletics light, rugby, baseball and other sports that can be played on a turf.

BACKGROUND OF THE INVENTION

It is well known that turfs for sport fields such as for soccer, hockey, cricket, rugby, etc. provide a natural turf grown on a ground or substrate. Natural turfs offer high aesthetical, technical and environmental performances.

However, with the use and with time, as well as with unfavorable weather conditions the natural turf quickly wears and requires expensive maintenance work. Unless a worn natural turf is completely restored the field there is anaesthetical, irregular, and potentially dangerous for the users.

An intense activity, which normally concerns a sport field, worsens the turf characteristics after each use without enough time for the turf to recover. In particular, the field looses its planarity, uniformity and resistance of its substrates, affecting the athletic performances and endangering the athletes.

For these reasons, fields of artificial blades have been developed in the last years, having artificial grass blades and granular filling material, for example sand or resilient material, which presents better performances and steadiness of grip on the ground. Such artificial turfs can be installed on surfaces made of various material, in particular asphalt, and stabilized inert material.

Artificial turfs have some technical drawbacks, among which a considerable superheating of the field in addition to environmental modifications with subsequent discomfort for the users. For avoiding the above described drawbacks combined systems have been proposed of mixed natural and artificial turf. A combined system natural/artificial is described in U.S. Pat. No. 6,145,248. It provides substantially a biodegradable substrate to which grass blades are connected of artificial material and on which a layer is located of soil in which is natural grass is sowed. With time the roots of the grass spread and the biodegradable substrate disintegrates. Therefore, the roots reach the ground located underneath the substrate and radicate in it.

However, this solution is strictly bound to the availability of a ground and has strong applicative limits, because it cannot be used in case of surfaces where artificial turfs are usually installed.

SUMMARY OF THE INVENTION

It is therefore a feature of the present invention to provide a method for making a turf that can be laid and removed, in a substantially "travelling" way, on surfaces of any kind, for example of concrete, asphalt, glass, bricks, metal, stabilized inert material, wood, moquette, plastic linings, etc.

It is another feature of the present invention to provide a turf that has technical features optimal for playing sports such as soccer, 5 players soccer, tennis, hockey, football, golf, athletics, rugby, baseball, concerning elasticity of the field, rebound of balls, capacity of absorbing shocks, resistance against pull and torsion caused by shoes, etc.

It is a further feature of the present invention to provide a turf that can be easily carried, rolled up, turned over without being damaged, and laid in a desired moment on a support surface for immediate use for the above sports and/or purposes, as well as that can be easily removed and immediately reused.

It is a further feature of the present invention to provide a turf that can bear also a heavy and concentrate activity without affecting its features.

These and other objects are achieved with the method for making a mixed turf for playing sport, for recreation and/or for ornamental purpose comprising the steps of:

prearranging a flexible not biodegradable support suitable for working as barrier for grass roots;

fixing a plurality of fibres of artificial material to said support, in order to form an artificial turf on one side of said support;

laying said support on a plane;

spreading on said support a granular filling material that fills the space among the fibres, said granular filling material being suitable for keeping substantially vertical said fibres, leaving the fibres to protrude at least 10 mm upwards;

introducing living vegetable material in said granular material, forming a natural turf that extends upwards more than said artificial turf, allowing radication of said living vegetable material exclusively above said support, said radication keeping said granular material stable and causing it to be integral to said fibres, said mixed turf being suitable for being carried, rolled up, turned over without spreading said granular material, and laid in a desired moment on a desired support surface for immediate use for any activity and/or purpose, and removed in a desired moment thanks to the absence of radication under said support.

In particular, the fastening step of the fibres of artificial material to the support provides the application of at least one continuous layer of resinous material suitable for being hardened by a process selected from the group:

thermosetting;

vulcanization;

catalysis.

Advantageously, the living vegetable material can be inserted on the support in a way selected from the group: sowing, transplantation or a combination thereof.

In particular, the support provides small draining holes, suitable for allowing the drainage preventing radication through them.

Advantageously, the step of spreading the granular filling material provides spreading at least one layer of rubber granules.

Preferably, the granular filling material consists only of rubber granules.

In a possible embodiment of the invention, under said at least one layer of granular filling material a layer of mineral granular material is arranged, for example sand or gravel.

In a further exemplary embodiment, above the layer of mineral granular material a step is provided of creating a layer of organic material suitable to assure ideal growth conditions to the living vegetable material and to provide nutritive substances.

Preferably, at least one part of the fibres of artificial material protrude upwards at least 10 mm from the filling layer.

According to another aspect of the invention, a turf for playing sport, for recreation and/or for ornamental purpose comprises:

a flexible not biodegradable support suitable for working as barrier for grass roots;

a plurality of fibres of artificial material connected to said support, in order to form an artificial turf on one side of said support;

a granular filling material that fills the space among the fibres, said granular filling material being suitable for keeping substantially vertical said fibres, leaving the fibres to protrude at least 10 mm upwards;

living vegetable material arranged within said granular material, forming a natural turf that extends upwards more than said artificial turf, said living vegetable material being radicated exclusively above said support, said radication keeping said granular material stable and causing it to be integral to said fibres, said mixed turf being suitable for being carried, rolled up, turned over without spreading said granular material, and laid in a desired moment on a desired support surface for immediate use for any activity and/or purpose, and removed in a desired moment thanks to the absence of radication under said support.

This way, it is possible to lay the turf on a field of a desired type, for example on concrete, asphalt, glass, bricks, metal, stabilized inert material, wood, moquette, plastic linings.

Preferably, the distance between two successive fibres of artificial material is set between 1 cm and 3 cm.

In an exemplary embodiment of the invention, the fibres of artificial material of the turf comprise smooth fibres alternated to wavy fibres. The wavy fibres giving steadiness to the granular filling material and enhancing the radication of the living vegetable material.

Advantageously, above the support a layer of mineral granular material is arranged, for example sand or gravel.

In an exemplary embodiment, above the layer of mineral granular material a layer of organic material is provided suitable for creating ideal hydrologic conditions for the development of the living vegetable material and for supplying the necessary nutritive substances.

Preferably, the organic material is selected from the group: cork, coconut, peat, sawmill residues, residues of agricultural and food factories, compost, ammendante, organic fertilizers, cornunghia, roasted leather, vegetable residues, and normally a desired organic material of vegetable and/or animal origin granular and/or fibrous.

Preferably, the living vegetable material is selected from the group: monocotyledonous, dicotyledonous vegetable species, propagable by seeds or by parts of plants.

Preferably, the granular filling material is resilient material selected from the group: caoutchouc, silicon rubber, SBR, EPDM, SBS, SEBS or combination thereof.

Advantageously, the support has small draining holes suitable for allowing the drainage of the rainwater, or of irrigation water, preventing radication through them.

BRIEF DESCRIPTION OF THE DRAWINGS

The invention will now shown with the following description of an exemplary embodiment thereof, exemplifying but not limitative, with reference to the attached drawings wherein.

DESCRIPTION OF A PREFERRED EXEMPLARY EMBODIMENT

Figure 1:
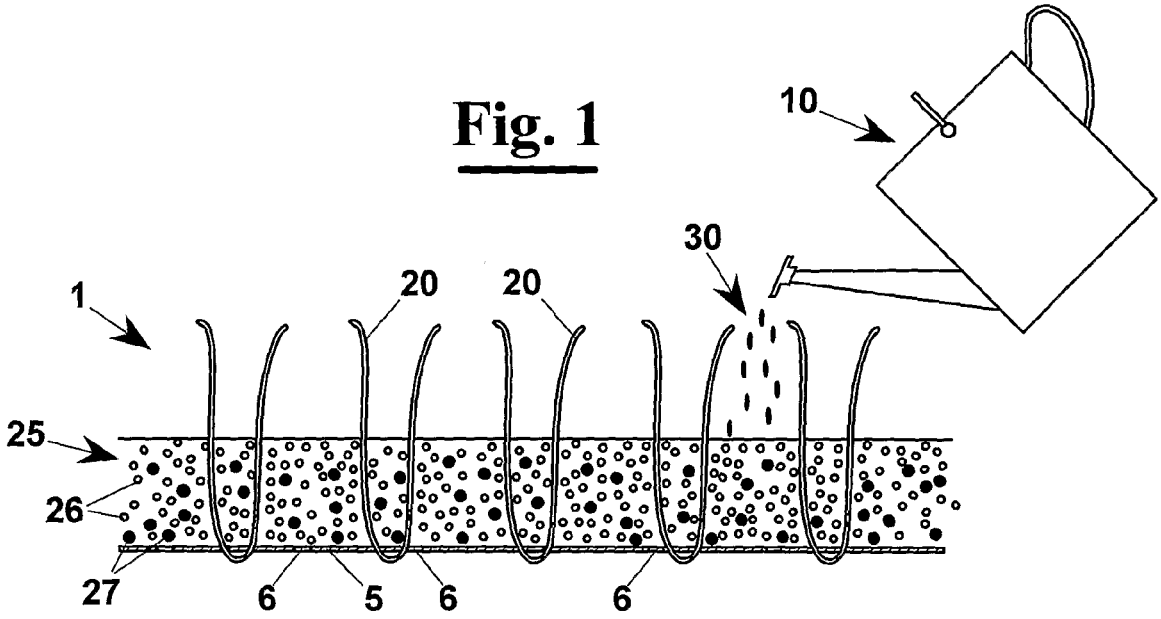
FIG. 1 shows diagrammatically a cross sectional view of a first exemplary embodiment of a turf, according to the present invention.

With reference to FIG. 1, a first exemplary embodiment of a turf 1 for playing sport, for recreation and/or for ornamental purpose, according to the invention, comprises a flexible not biodegradable support 5 having a plurality of holes 6 for allowing the drainage of water through support 5 same. To flexible support 5 fibres 20 are connected of artificial material in order to form a turf of artificial blades extending from the upper side of support 5. The fibres 20 are then kept substantially vertical by a granular filling material 25 that fills the space among the fibres 20 same. More in detail, the fibres 20, substantially U-shaped, are firstly fixed to support 5 and then connected to it by a synthetic vulcanized resin in order to provide a steady fastening.

In particular, the granular filling material 25 is made of rubber granules 26, for example selected from the group of: caoutchouc, silicon rubber, SBR, EPDM, SBS, SEBS or combination thereof. The turf 1 is then completed by living vegetable material put into the granular material by means of sowing (FIG. 1), transplantation of portions of plants 15 (FIG. 2) or a combination of the two solutions. Finally, the living vegetable material in the form of seeds 27, or of portions of plants 15, is watered and dressed as known in the art.

Figure 2:
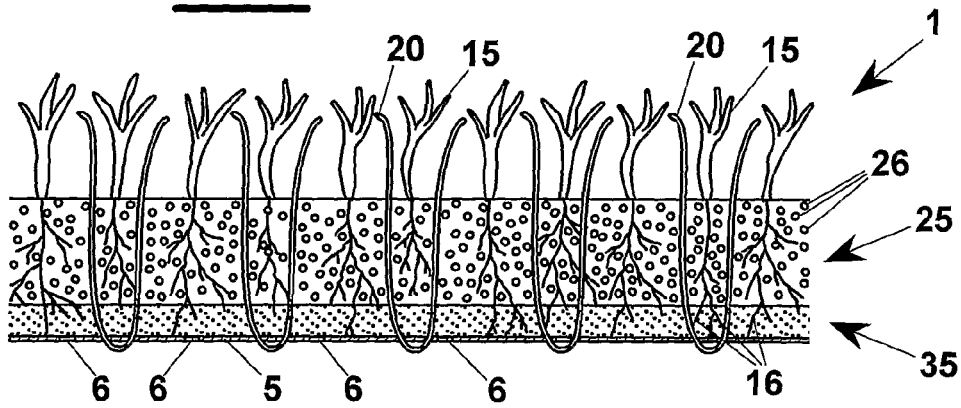
FIG. 2 shows diagrammatically a cross sectional view of an exemplary embodiment of a turf alternative to that of FIG. 1.

In FIG. 2 an alternative exemplary embodiment is diagrammatically shown of the turf of FIG. 1. In particular, below the layer of granular filling material 25 a layer of mineral granular material 35 is present, for example consisting of sand or gravel.

Figure 3:
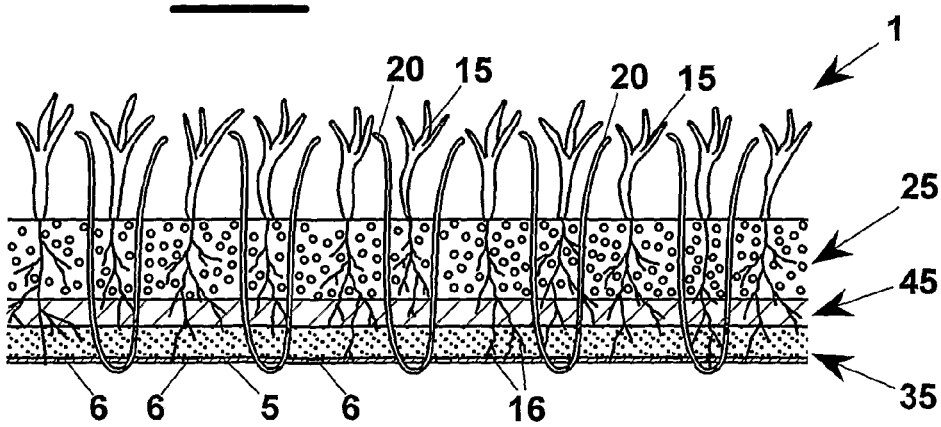
FIG. 3 shows diagrammatically a cross sectional view of a further exemplary embodiment of a turf.

In a further exemplary embodiment, shown in FIG. 3, above the layer of mineral granular material 35 a layer of organic material 45 is provided, suitable for optimizing physical/chemical conditions for the development of the plants 15. The organic material that can be used can be, for example, cork, coconut, peat, sawmill residues, residues of agricultural and food factories, compost, organic soil, organic fertilizers, cornunghia, roasted leather, vegetable residues, and normally a desired organic material of vegetable and/or animal origin granular and/or fibrous.

In all the exemplary embodiments above described, the living vegetable material 15 radicates above flexible support 5. In other words, the roots 16 do not pass through flexible support 5. This way, it is possible to lay the turf on a surface of a desired type, for example on asphalt, concrete, stabilized inert material and in a desired moment it can be removed and carried on another surface.

Figure 4:
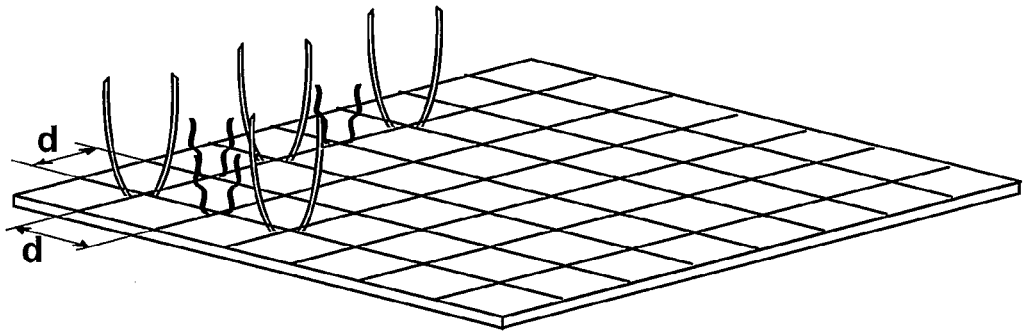
FIG. 4 shows another possible exemplary embodiment of a turf.
Figure 5:
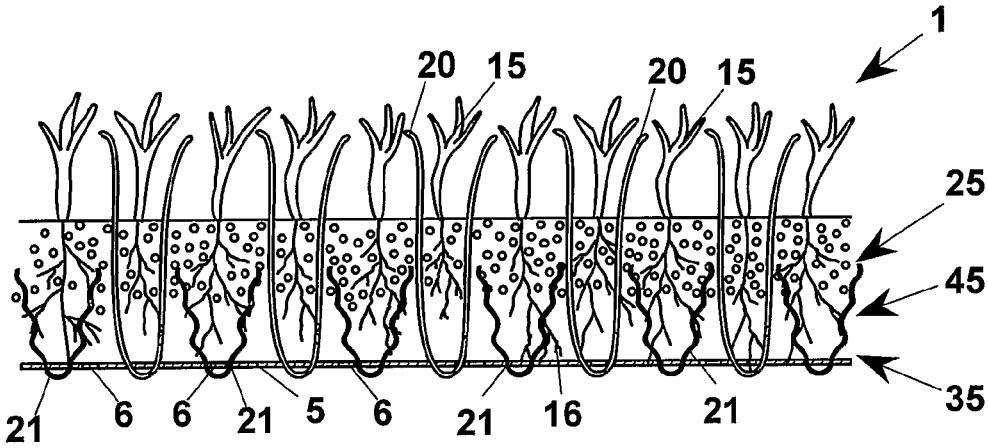
FIG. 5 shows diagrammatically a cross-sectional view of another exemplary embodiment of a turf rovidin alternating smooth fibres and wavy fibres.

In FIG. 4 a possible exemplary embodiment is shown of the turf 1, where the distance between two successive fibres of artificial material is set between 1 cm and 3 cm. More in detail, as shown in FIG. 5, the spatial distribution of the fibres of artificial material 20 on the turf is of reticular type and provides the alternation of smooth fibres 20 and of wavy fibres 21, the former protruding from the layer of granular filling material and the latter remaining immersed in it. The wavy fibres 21 confer a higher steadiness to the filling and assist the anchorage of the living vegetable material 15.

The turf 1 can be transported, rolled up, turned over without spreading the granular material.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realize the different functions described herein could have a different nature without, for this reason, departing from the field of the invention. It is to be understood that the phraseology or terminology employed herein is for the purpose of description and not of limitation.

The invention claimed is:

1. Method for making a turf for playing sport, for recreation and/or for ornamental purpose comprising the steps of:

prearranging a flexible, not biodegradable support suitable for working as barrier for grass roots;

fixing a plurality of U-shaped fibres of artificial material to said support, in order to form a turf of artificial blades extending from an upper side of said support;

laying said support on a plane;

spreading on said support a granular filling material that fills the space among the fibres, said granular filling material being suitable for keeping substantially vertical said fibres, leaving the fibres to protrude at least 10 mm upwards;

introducing living vegetable material in said granular material, forming a natural turf that extends upwards more than said artificial turf; and allowing radication of said living vegetable material exclusively above said support, said radication keeping said granular material stable and causing it to be integral to said fibres, whereby the turf can be carried, rolled up, turned over without spreading said granular material, and laid in a desired moment on a desired support surface for immediate use for any activity and/or purpose, and removed in a desired moment thanks to the absence of radication under said support.

2. Method, according to claim 1, wherein said fastening step of said fibres of artificial material to said support provides the application of at least one continuous layer of resinous material suitable for being hardened by a process selected from the group consisting of:

thermosetting;

vulcanization; and catalysis.

3. Method, according to claim 1, wherein said living vegetable material is inserted on said support in a way selected from the group consisting of sowing, transplantation, and a combination thereof.

4. Method, according to claim 1, wherein said support provides small draining holes, suitable for allowing the drainage preventing radication through them.

5. Method, according to claim 1, wherein said step of spreading granular filling material provides spreading at least one layer of rubber granules.

6. Method, according to claim 1, wherein said granular filling material consists only of rubber granules.

7. Method, according to claim 1, wherein under said at least one layer of granular filling material a layer of mineral granular material is arranged.

8. Method, according to claim 7, wherein a step is provided of creating a layer of organic material above said layer of mineral granular material, said layer of organic material being suitable to assure ideal growth conditions to said living vegetable material and to provide nutritive substances.

9. Method, according to the claim 1 wherein at least one part of said fibres of artificial material protrude upwards at least 10 mm from said filling layer.

10. Turf for playing sport, for recreation and/or for ornamental purpose comprising:

a flexible not biodegradable support suitable for working as barrier for grass roots;

a plurality of U-shaped fibres of artificial material connected to said support, in order to form a turf of artificial blades extending from an upper side of said support;

a granular filling material that fills the space among the fibres, said granular filling material being suitable for keeping substantially vertical said fibres, leaving the fibres to protrude at least 10 mm upwards; and living vegetable material arranged within said granular material, forming a natural turf that extends upwards more than said artificial turf, said living vegetable material being radicated exclusively above said support, said radication keeping said granular material stable and causing it to be integral to said fibres, said turf being suitable for being carried, rolled up, turned over without spreading said granular material, and laid in a desired moment on a desired support surface for immediate use for any activity and/or purpose, and removed in a desired moment thanks to the absence of radication under said support.

11. Turf, according to claim 10, where the distance between two successive fibres of artificial material is set between 1 cm and 3 cm.

12. Turf, according to claim 10, wherein said fibres of artificial material comprise smooth fibres alternated to wavy fibres.

13. Turf, according to claim 10, wherein above said support a layer of mineral granular material is arranged.

14. Turf, according to claim 13, wherein above said layer of mineral granular material a layer of organic material is provided suitable for creating ideal hydrologic conditions for development of the living vegetable material and for supplying the necessary nutritive substances.

15. Turf, according to claim 14, wherein said organic material is selected from the group consisting of cork, coconut, peat, sawmill residues, residues of agricultural and food factories, compost, organic soil, organic fertilizers, cornunghia, roasted leather, vegetable residues, and normally a desired organic material of vegetable and/or animal origin granular and/or fibrous.

16. Turf, according to claim 10, wherein said living vegetable material is selected from the group consisting of monocotyledonous and dicotyledonous vegetable species, sowed or replicated through parts of plants.

17. Turf, according to claim 10, wherein said granular filling granular material is a resilient material selected from the group consisting of caoutchouc, silicone rubber, styrene butadiene rubber, ethylene propylene diene monomer, styrene butadiene styrene, stryene ethylbutylene styrene and a combination thereof.

18. Turf, according to claim 10, wherein said support provides small draining holes, suitable for allowing the drainage preventing radication there through.

* * * * *